United States Patent [19]

Aruga et al.

[11] Patent Number: 4,966,106

[45] Date of Patent: Oct. 30, 1990

[54] CAMSHAFT DRIVING ARRANGEMENT FOR DOUBLE OVERHEAD CAMSHAFT ENGINE

[75] Inventors: Tatsuo Aruga, Kawasaki; Yoshio Iwasa, Nagareyama, both of Japan

[73] Assignee: Nissan Motor Co., Ltd., Yokohama, Japan

[21] Appl. No.: 450,510

[22] Filed: Dec. 14, 1989

[30] Foreign Application Priority Data

Dec. 21, 1988 [JP] Japan ..... 63-320593

[51] Int. Cl.[5] ..... F01L 1/02

[52] U.S. Cl. ..... 123/90.31; 123/195 C

[58] Field of Search ..... 123/90.17, 90.27, 90.31, 123/195 C, 198 E

[56] References Cited

U.S. PATENT DOCUMENTS

| | | | |
|---|---|---|---|
| 4,516,546 | 5/1985 | Choushi et al. | 123/195 C |
| 4,553,473 | 11/1985 | Ichida et al. | 123/90.27 |
| 4,607,601 | 8/1986 | Kohler | 123/90.31 |
| 4,643,143 | 2/1987 | Uchiyama et al. | 123/90.31 |
| 4,648,359 | 3/1987 | Ito | 123/90.31 |
| 4,674,452 | 6/1987 | Asanomi | 123/90.27 |
| 4,750,455 | 6/1988 | Ebesu | 123/90.31 |
| 4,878,467 | 11/1989 | Schmidt | 123/198 E |
| 4,883,031 | 11/1989 | Ampferer | 123/198 E |

FOREIGN PATENT DOCUMENTS

| | | | |
|---|---|---|---|
| 15612 | 1/1984 | Japan | 123/90.27 |

*Primary Examiner*—Charles J. Myhre
*Assistant Examiner*—Weilun Lo
*Attorney, Agent, or Firm*—Pennie & Edmonds

[57] ABSTRACT

A camshaft driving arrangement for a DOHC engine comprises two pairs of sprockets, each pair being mounted to the adjacent pair of camshafts, and two idler gears rotatably mounted to the cylinder banks, respectively. A timing chain drivingly interconnects the crankshaft and the two idler gears. On the other hand, two camshaft driving chains each interconnect one of the two idler gears and the adjacent two cam sprockets. A front cover is so constructed and arranged as to conceal the two idler gears and the timing chain.

2 Claims, 5 Drawing Sheets

CAMSHAFT DRIVING ARRANGEMENT FOR DOUBLE OVERHEAD CAMSHAFT ENGINE

BACKGROUND OF THE INVENTION

The present invention relates to a camshaft driving arrangement for a double overhead camshaft (DOHC) engine having two camshafts for opening and closing suction and exhaust valves at each of cylinder heads.

Japanese Patent Publication No. 59-74312 (=U.S. Pat. No. 4,553,473) discloses a camshaft driving arrangement of the prior art as shown in FIG. 6.

Referring to FIG. 6, there is shown a so-called V-type DOHC engine in which a cylinder block 1 includes two cylinder banks 1A and 1B angularly disposed to each other. One 1A of the two cylinder banks has a plurality of cylinders displaced along the axis of a crankshaft 2 from a plurality of cylinders of the other bank 1B. There is provided a sprocket 3 at theend of the crankshaft 2 rotatably mounted to the cylinder block 1. Rotatably mounted to each of cylinder banks 1A and 1B are an intake camshaft 6 for opening and closing intake valves 5 and an exhaust camshaft 8 for opening and closing exhaust valves 7. Two idler gears 11 are rotatably mounted to the cylinder heads 4A and 4B, respectively. Each of the idler gears 11 has a large diameter gear 11A and a small diameter gear 11B. Fixdely mounted to the end of each of the camshafts 6 and 8 is a sprocket 9. Rotation of the crankshaft 2 is transmitted to the large gears 11A of the idler gears 11 through a rubber timing belt 10, causing rotation of the small gears 11B. Subsequently, the rotation of each of the small gears 11B is transmitted to the adjacent sprockets 9 through a chain 12. As a result, the intake camshafts 6 and the exhaust camshafts 8 are rotated synchronously, opening and closing the intake and exhaust valves 5 and 7. A tensioner 13 is used for adjusting the tension of the timing belt 10, and an idler gear 14 for stabilizing or ensuring an engagement of the timing belt 10.

With such conventional camshaft driving arrangement, case covers (not shown) for the timing belt 10 and the chains 12 are mounted to an engine body in overlapping the end portions of the case covers each other, and the timing belt 10 is designed to be large in width. This increases the overall length of the engine and the dimension of the case covers, and decreases the assembling efficiency of the timing belt 10 and the chain 12. Additionally, the tensioner 13 and the idler gear 14 are mounted between the two idler gears 11 so that the middle portion defined by the timing belt 10 cannot be used for installing engine's accessories.

An object of the present invention is to provide a camshaft driving arrangement which makes much contribution to reduced overall length and increased space for installing engine's accessories.

SUMMARY OF THE INVENTION

There is provided, accordig to the present invention, in a DOHC engine, the DOHC engine having a cylinder block including two cylinder banks angularly disposed to each other, two cylinder heads mounted on the two cylinder banks, respectively, two pairs of camshafts, each pair being rotatably mounted to one of the two cylinder heads, and a crankshaft, a camshaft driving arrangement comprising:

two pairs of sprockets, each pair being mounted to the adjacent pair of camshafts;

two idler gears rotatably mounted to the cylinder banks, respectively;

a timing chain drivingly interconnecting the crankshaft and said two idler gears;

two camshaft driving chains, each interconnecting one of said two idler gears and the adjacent two cam sprockets; and a front cover so constructed and arranged as to conceal said two idler gears and said timing chain.

DETAILED DESCRIPTION OF THE INVENTION

Referring to FIGS. 1 to 5, a preferred embodiment of the present invention will be described.

Figure 1:
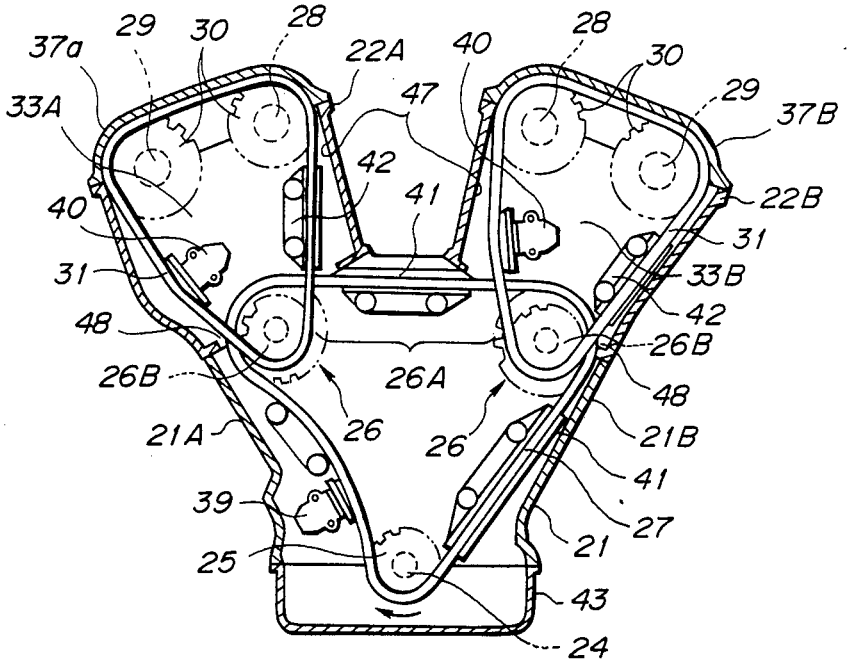
FIG. 1 is a diagrammatic vertical section of a front end portion of a V-type DOHC engine, illustrating embodiment of a camshaft driving arrangement according to the present invention.
Figure 2:
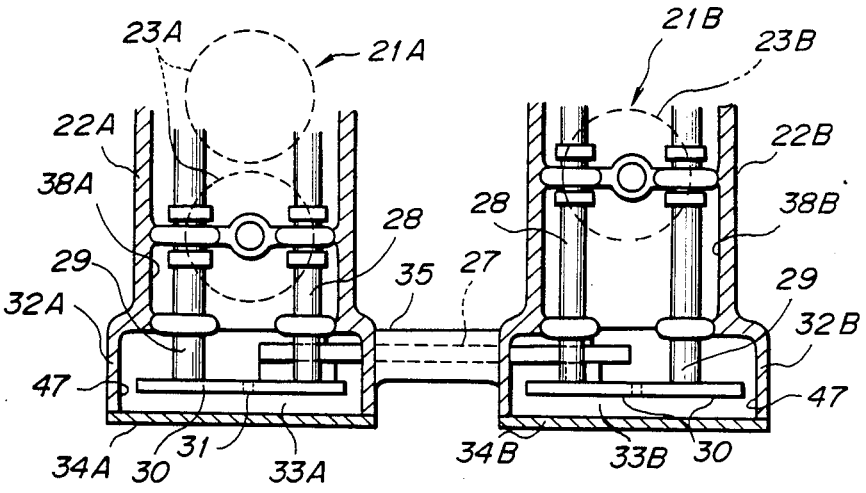
FIG. 2 is a diagrammatic horizontal section, slightly enlarged, of a front end portion of the engine.
Figure 3:
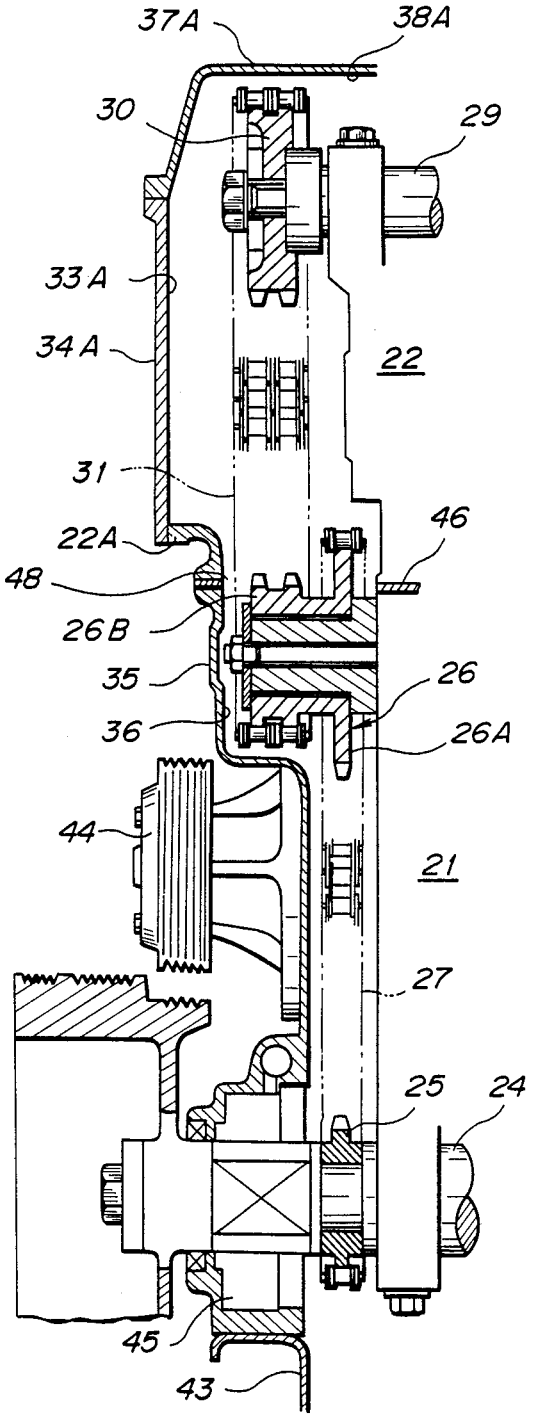
FIG. 3 is an enlarged vertical section of the front end portion of the engine.

Referring first to FIGS. 1 to 3, a cylinder block 21 includes two cylinder banks 21A and 21B angularly disposed to each other. Cylinder heads 22A and 22B are mounted through gaskets 46 on the top of the cylinder banks 21A and 21B, respectively.

Between two adjacent cylinders 23A of the one cylinder bank 21A, a cylinder 23B of the other cylinder bank 23B is disposed as shown in FIG. 2.

A crankshaft 24 is rotatably mounted to the lower portion of the cylinder block 21. A crankshaft sprocket 25 is mounted to the crankshaft 24. Two idler gears 26 are rotatably mounted to the cylinder banks 21A and 21B, respectively. Each of the idler gears 26 includes a large gear 26A and a small gear 26B which are constructed in monoblock. A timing chain 27 drivingly interconnects the crankshaft sprocket 25 and the large gears 26A of the idler gears 26. The gear ratio of the crankshaft sprocket 25 to each of the large gears 26A is so determined that one rotation of the crankshaft 24 causes each of the idler gears 26 to rotate from $\frac{3}{4}$ to $\frac{1}{2}$ rotation.

An intake camshaft 28 and an exhaust camshaft 29 are rotatably mounted at the upper portion of each of the cylinder heads 22A and 22B. The intake camshaft 28 is used for opening and closing intake valves (not shown), and the exhaust camshaft 29 for opening and closing exhaust valves (not shown). There are provided sprockets 30 mounted at the ends of the camshafts 28 and 29. In each of the cylinder banks 21A and 21B, a camshaft driving chain 31 drivingly interconnects the small gear 26B of the idler gear 26 and the adjacent two camshaft sprockets 30.

End portions 32A and 32B of the cylinder heads 22A and 22B are so protruded laterally as to form sprocket chambers 33A and 33B having upper, lower and lateral openings.

The amount of the protrusion of the end portion 32B of the other cylinder bank 21B is designed to be greater than that of the protrusion of the end portion 32A of the one cylinder bank 21A. This allows the two camshaft driving chains 31 for the cylinder banks 21A and 21B to be disposed in substantially the same plane.

Sprocket covers 34A and 34B are provided on longitudinal end walls of the cylinder heads 22A and 22B respectively, each being in the form of a plate which closes an opening of each of the sprocket chambers 33A and 33B. In order to conceal the two idler gears 26 and the camshaft driving chain 27, a single aluminum front cover 35 is attached to the cylinder block 21. A reference numeral 36 designates an idler gear chamber. On the top of each of the cylinder heads 22A and 22B, there are provided cam covers 37A and 37B which conceal the intake and exhaust camshafts 28 and 29, thus forming cam chambers 38A and 38B. An opening 48 which allows communication of the sprocket chambers 33A and 33B with the idler gear chamber 36 is sized to be greater than the idler gear 26.

Each attachment area of the cylinder heads 22A and 22B with the cam covers 37A and 37B is formed to be continuous and flat.

Figure 4:
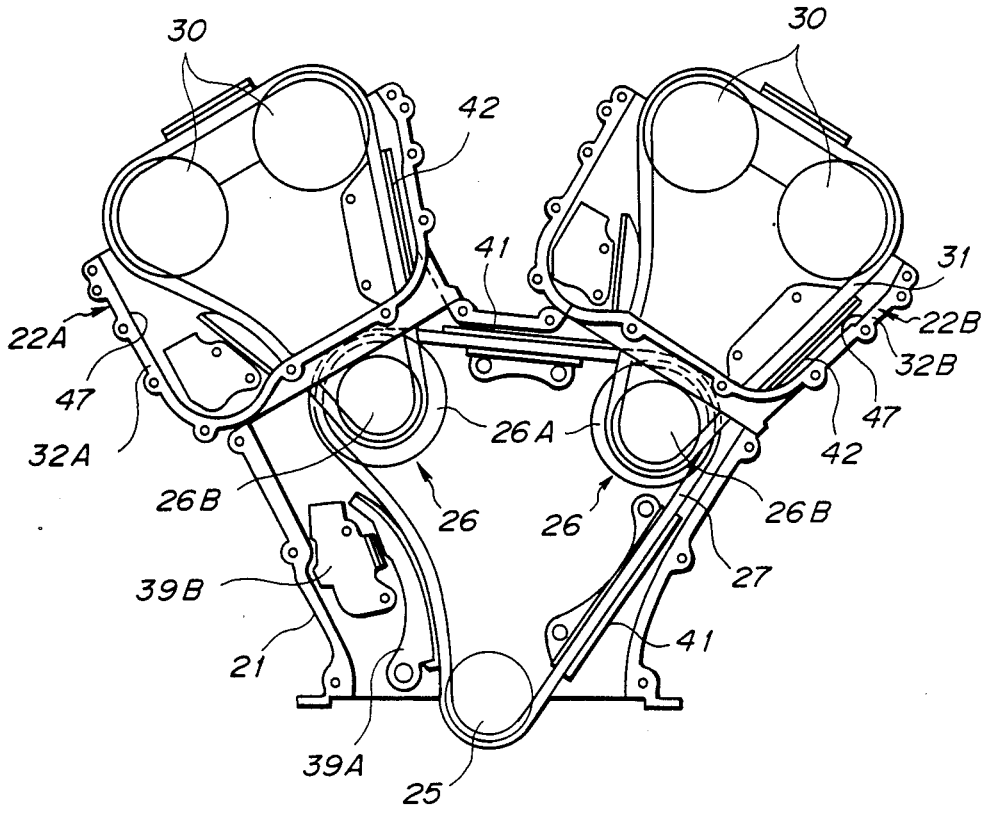
FIG. 4 is a view similar to FIG. 1 illustrating the engine shown in FIG. 3 with some components removed.
Figure 5:
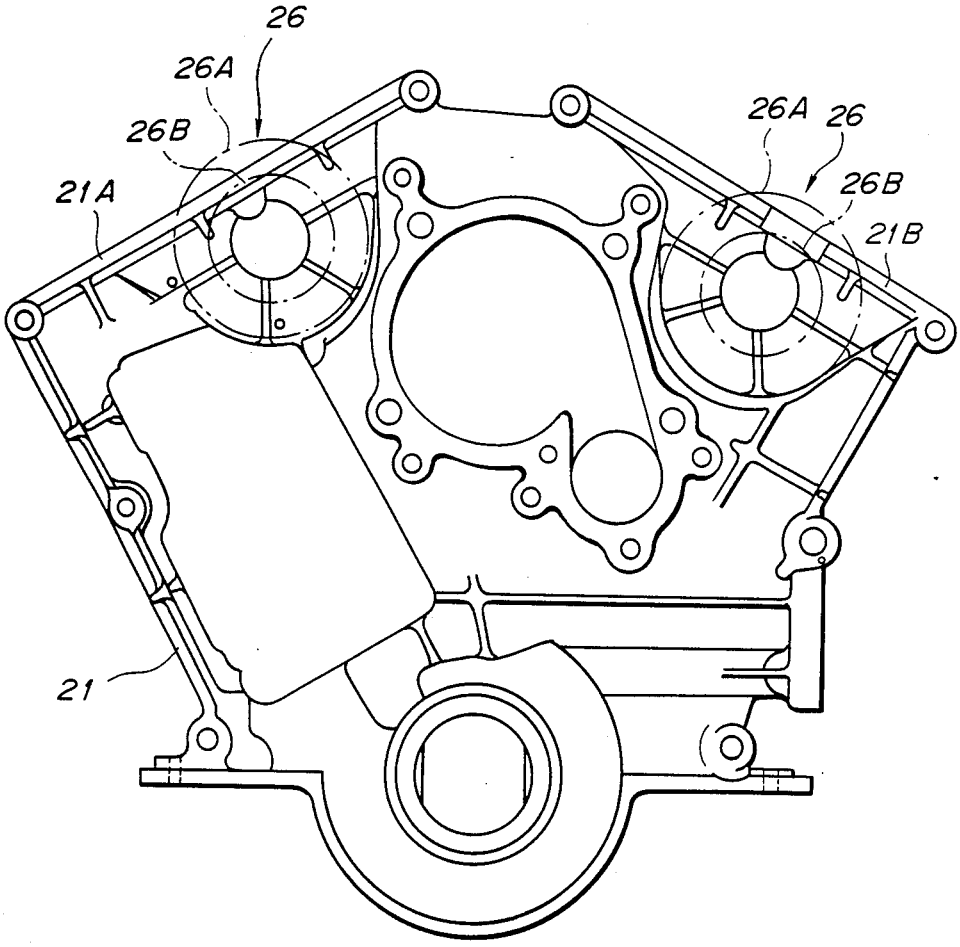
FIG. 5 is a front elevation of a cylinder block of the engine.
Figure 6:
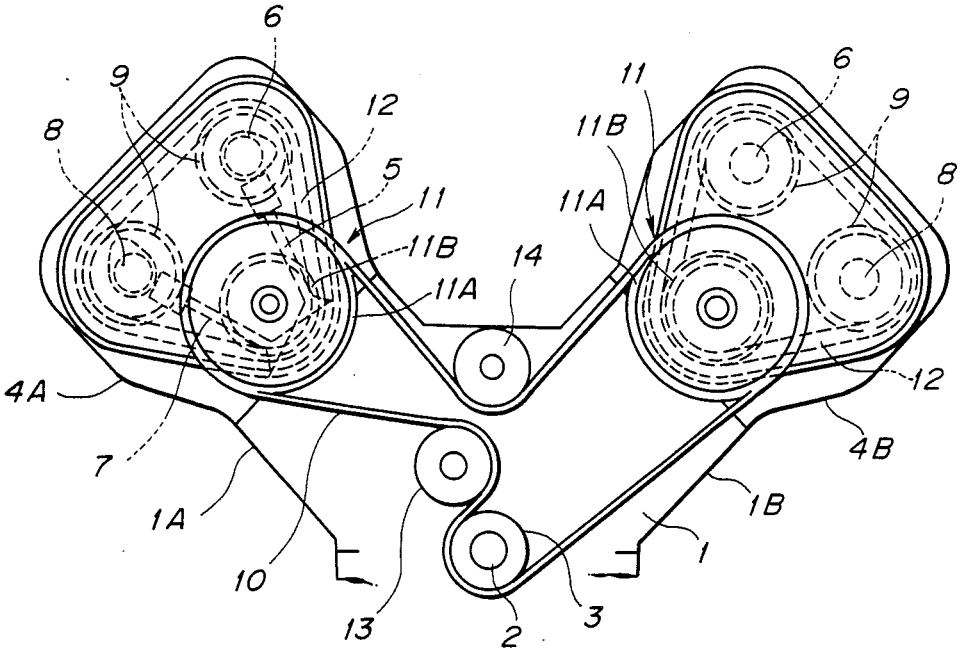
FIG. 6 (PRIOR ART)
FIG. 6 is a diagrammatic view illustrating a camshaft driving arrangement of the prior art discussed before.

A movable tensioner 39 is mounted to the lower portion of the cylinder block 21 for adjusting the tension of the timing chain 27, whereas a movable tensioner 40 is mounted to each of the cylinder heads 22A and 22B for adjusting the tension of one of the camshaft driving chains 31. As shown in FIG. 4, the movable tensioner 39 may comprise a swing member 39A to be in contact with the first chain 27 and an adjuster 39B to move the swing member 39A.

A reference numeral 41 designates a fixed tensioner for the timing chain 27, 42 a fixed tensioner for the camshaft driving chain, 43 an oil pan, 44 a water pump, and 45 an oil pump.

With such a structure, since the idler gear 26 is provided for each of the cylinder banks 21A and 21B on the upper portions of the cylinder block 21 thereof, it is possible to enlarge the middle portion of the front cover 35 or a triangular space defined by the two idler gears 26 and the crankshaft 24. This allows installation of engine's accessories such as water pump 44 in this middle portion, resulting in reduction of engine dimension.

Additionally, the two idler gears 26 of the cylinder banks 21A and 21B are concealed by the single front cover 35 without overlapping the sprocket covers 34A and 34B, so that the engine can assume an improved oil tightness of the cylinder block 21 and a reduced thickness or width of the front cover 35 of the idler gears 26 compared with a conventional engine with a rubber timing belt.

The two camshaft driving chains 31 within the sprocket chambers 33A and 33B are disposed in substantially the same plane so that the two idler gears 26 are also disposed in substantially the same plane. This allows the same chain arrangement for each of the idler gears 26. Specifically, the timing chain 27 can be arranged on the end of the cylinder block 21, whereas each camshaft chain 31 can be arranged on the same end. As a result, it is possible to prevent an assembly error of the two idler gears 26, and improve a visibility of reference marks for the timing chain 27 and each of the large gears 26A and for the camshaft driving chain 31 and each of the sprockets 30, thus resulting in an improved productivity. Particularly, it is advantageous for the improved productivity that the tension of the timing chain 27 for connecting the cylinder block 21 to the cylinder heads 22A and 22B can be set.

The opening 47 is formed for each of the sprocket chambers 33A and 33B so that it is easy to install or remove the sprockets 30, the camshaft driving chains 31, the movable tensioners 40, and the fixed tensioners 42, and a confirmation of their mounting conditions. The opening 47, which is sealed with the sprocket covers 34A and 34B, has no oil leak.

Since there is provided at the lower portion of each of the sprocket chambers 33A and 33B the opening 48 which allows communication with the idler gear chamber 36, and the opening 48 is sized to be larger than the idler gear 26, it is possible to mount the idler gear 26 in a manner to be salient on the side of the cylinder heads 22A and 22B, thus allowing an enlargement of the middle space of the front cover 35. Each of the sprocket chambers 33A and 33B communicates with the idler gear chamber 36 through the opening 48. As a result, a lubrication oil within the cam chambers 38A and 38B are returned into the oil pan 43 through the sprocket chambers 38A and 38B, and the idler gear chamber 36. A blow-by gas which flows out from the upper portion of the oil pan 43 is introduced into a suction passage through the idler gear chamber 36, the sprocket chambers 34A and 34B, and the cam chambers 38A and 38B.

Upper surfaces of the cylinder heads 22A and 22B, and the sprocket chambers 33A and 33B are formed to be continuous and flat so that an excellent oil tightness can be maintained by the cam covers 37A and 37B.

What is claimed is:

1. In a DOHC engine, the DOHC engine having a cylinder block including two cylinder banks angularly disposed to each other, two cylinder heads mounted on the two cylinder banks, respectively, two pairs of camshafts, each pair being rotatably mounted to one of the two cylinder heads, and a crankshaft, a camshaft driving arrangement comprising:

two pairs of sprockets, each pair being mounted to the adjacent pair of camshafts;

two idler gears rotatably mounted to the cylinder banks, respectively;

a timing chain drivingly interconnecting the crankshaft and said two idler gears;

two camshaft driving chains, each interconnecting one of said two idler gears and the adjacent two cam sprockets; and a front cover so constructed and arranged as to conceal said two idler gears and said timing chain.

2. A camshaft driving arrangement as claimed in claim 1, wherein said two camshaft driving chains are disposed in substantially the same plane.

* * * * *